US006151783A

United States Patent [19]

Morales

[11] Patent Number: 6,151,783

[45] Date of Patent: Nov. 28, 2000

[54] WIRE CUTTER SHIELD

[76] Inventor: Steve Morales, 1105 Green Downs Dr., Round Rock, Tex. 78664

[21] Appl. No.: 09/136,542

[22] Filed: Aug. 19, 1998

[51] Int. Cl.[7] ..... B26B 1/00

[52] U.S. Cl. ..... 30/124; 30/136; 30/233

[58] Field of Search ..... 30/233, 124, 136

[56] References Cited

U.S. PATENT DOCUMENTS

| | | | |
|---|---|---|---|
| 1,174,175 | 3/1916 | Moster | 30/233 |
| 1,862,556 | 6/1932 | Welhaven . | |
| 2,146,132 | 2/1939 | Scholl . | |
| 2,507,345 | 5/1950 | Meesook . | |
| 2,521,027 | 9/1950 | Sorensen . | |
| 2,620,560 | 12/1952 | Bahr | 30/124 |
| 2,711,584 | 6/1955 | Crider . | |
| 3,010,206 | 11/1961 | Curry | 30/233 X |
| 3,680,210 | 8/1972 | Steinman . | |
| 3,763,560 | 10/1973 | Makkay et al. . | |
| 4,247,983 | 2/1981 | Jansson et al. . | |
| 5,201,254 | 4/1993 | Davies | 30/124 X |
| 5,542,435 | 8/1996 | Kelly et al. | 128/846 |

FOREIGN PATENT DOCUMENTS

| | | | |
|---|---|---|---|
| 121313 | 6/1901 | Germany | 30/233 |
| 192902 | 12/1907 | Germany | 30/233 |

*Primary Examiner*—M. Rachuba
*Attorney, Agent, or Firm*—Larry Mason Lee

[57] ABSTRACT

A resilient, deformable shield for a hand tool comprising a guard, a guard handle, and an attachment means for attaching the shield to a hand tool. The guard provides a volumetric enclosure having an aperture for passage of the cutting edge of a hand tool. The guard handle provides a first end and a second end; the guard handle is attached at the first end to the guard. The guard handle's second end is detachably connected to a hand tool. The guard handle may resiliently deform and pivot perpendicular to its long axis, thereby permitting movement of he cutting portion of a hand tool into and out of the volumetric enclosure.

6 Claims, 3 Drawing Sheets

WIRE CUTTER SHIELD

BACKGROUND OF THE INVENTION

1. Field of Invention

The subject invention is related to an attachment for a hand tool, and more specifically to a shield for a wire cutting tool or snipping tool. The subject invention is more directly related to an attachment for a hand tool that protects the user, or other individuals close to the user, from debris propelled away from a hand tool during use of the hand tool.

2. Description of the Related Art

Tools used for clipping some materials, such as wire, solder, fingernails, etc. can often propel the clipped portion or clippings in a quick and unpredictable fashion. These clippings may cause injury to the user of the tool, or persons adjacent to the user. This problem is especially prevalent in today's micro-processor and computer industry—where copious numbers of circuit boards are manufactured. To properly prepare a circuit board for installation extraneous lengths of wire or solder must be identified and subsequently clipped away from each circuit board. Each technician responsible for clipping away these extraneous lengths of wire or solder is subject to injury from flying bits of wire or solder. Various devices exist which were designed to protect an individual using a clipping tool, or personnel adjacent the individual, from potentially dangerous flying clippings. However, there is considerable room for improvement in the field for shields for wire cutting tools and snipping tools.

The prior art includes a device which is an attachment for a wire cutting device and is intended to guard the user of the wire cutting device, or personnel in close proximity to the user, from injuries due to debris flying from the wire cutting device. Such a device is taught by U.S. Pat. No. 2,711,584. The device of U.S. Pat. No. 2,711,584 is comprised of a guard for a wire cutting tool, wherein the guard provides a pair of spaced side walls with integrally formed bottom and closure walls. U.S. Pat. No. 2,711,584 further discloses a bracket means for attaching the guard to a wire cutting device—the method of attaching the guard to a wire cutting device is comprised of smelting, welding or soldering. The guard taught in U.S. Pat. No. 2,711,584 is rigid and rigidly attached to the wire cutting device The prior art also includes a wire retainer and a diagonal or side cutting nipper with a wire retainer. The wire retainer, is made from sheet metal and is an attachment to a diagonal or side cutting nipper (a wire cutter); the wire retainer impinges upon the piece of wire being cut. The wire retainer is designed to prevent offcuts from dropping when wire is cut by an individual using the diagonal or side cutting nipper. Such devices are disclosed in U.S. Pat. Nos. 4,247,983, 3,765,560 and 1,862,556. The wire retainers disclosed in U.S. Pat. Nos. 4,247,983, 3,765,560 and 1,862,556 are rigidly secured to the diagonal or side cutting nipper, and the wire retainers are designed to contact the cutting portion of the diagonal or side cutting nipper during use of the nipper.

Several problems remain unresolved in the prior art. No device in the discovered prior art is capable of being resiliently deformed, and all devices in the discovered prior art are comprised of multiple components.

Further, the prior art teaches devices that, while attached to wire cutters and acting as shields or retention devices, impinge upon the piece of wire being cut, thus permitting the probable escape of the wire end being snipped off. The escape is even more probable if the piece being snipped is small.

A yet further problem remaining unresolved in the prior art is that no device in the discovered prior art is capable of ready or easy attachment to a wire cutter, or ready or easy detachment from a wire cutter.

A further problem that remains unresolved with the prior art is that no device in the discovered prior art is capable of attachment to multiple locations on a wire cutter, thus making it difficult or impossible to attach the guard to more than a single specific location on a wire cutter.

A further and final problem existing with the prior art is that no device in the discovered prior art is adaptable to more than one type of wire cutter, or is adaptable to hand tools other than wire cutters.

Thus, there exists in the art a need for a shield for a hand tool that is comprised of a single piece construction, is deformable and resilient, is easily attachable to and detachable from a hand tool, is capable of attachment to various types of hand tools, and that can be attached to multiple locations on a hand tool.

SUMMARY OF THE INVENTION

The present invention is of a shield for a hand tool comprising a guard which integrally provides a guard handle. The shield is comprised of a deformable resilient material and includes a guard providing a volumetric enclosure with an aperture, wherein the aperture allows passage of the cutting edge of a hand tool into the volumetric enclosure. The guard handle provides a guard handle first end and a guard handle second end; the guard handle is attached at the guard handle first end to the guard exterior. The guard handle second end is detachably connected to a hand tool. The guard handle may resiliently deform and pivot perpendicular to its long axis, thereby raising or lowering the guard relative to the cutting portion of a hand tool (permitting movement of the cutting portion of such hand tool into and out of the volumetric enclosure).

The guard handle may be attached to the hand tool either by wedging the guard handle second end under a hand grip located on one of the hand tool handles, or by clips securing the guard handle second end to one of the hand tool handles. Since the shield may be secured to a hand tool either by slipping the guard handle under a hand tool hand grip, or by simply clipping the guard handle onto a hand tool handle, attaching or replacing the shield can be accomplished easily and quickly. Conversely, the shield may be easily removed, if it were desired to use the hand tool in a situation where the added shield could not be used. Additionally, due to the size, weight, and cost of the shield, multiple shields may be kept on hand and installed or replaced as needed.

Accordingly, it is an object of this invention is to provide a shield, to be used with a hand tool, that protects the user, and adjacent individuals, from flying debris propelled by the hand tool during use of the hand tool.

It is yet a further object of this invention to provide a shield for a hand tool wherein the shield is resilient and deformable.

It is yet a further object of this invention to provide a shield for a hand tool which is comprised of single-piece construction.

It is yet a further object of this invention to provide a shield for a hand tool wherein the shield is readily attachable and detachable from the hand tool.

It is yet a further object of this invention to provide a shield for a hand tool wherein the shield is attachable to various locations on the hand tool.

It is yet a further and final object of this invention to provide a shield for a hand tool that can be flexed into a multiplicity of positions about a line perpendicular to the shield while still protecting the user or adjacent individuals caused by flying debris propelled by the hand tool.

BRIEF DESCRIPTION OF THE DRAWINGS

A better understanding of the present invention can be obtained from the detailed description of exemplary embodiments set forth below, to be considered in conjunction with the attached drawings, in which.

DESCRIPTION OF THE PREFERRED EMBODIMENTS

Figure 1:
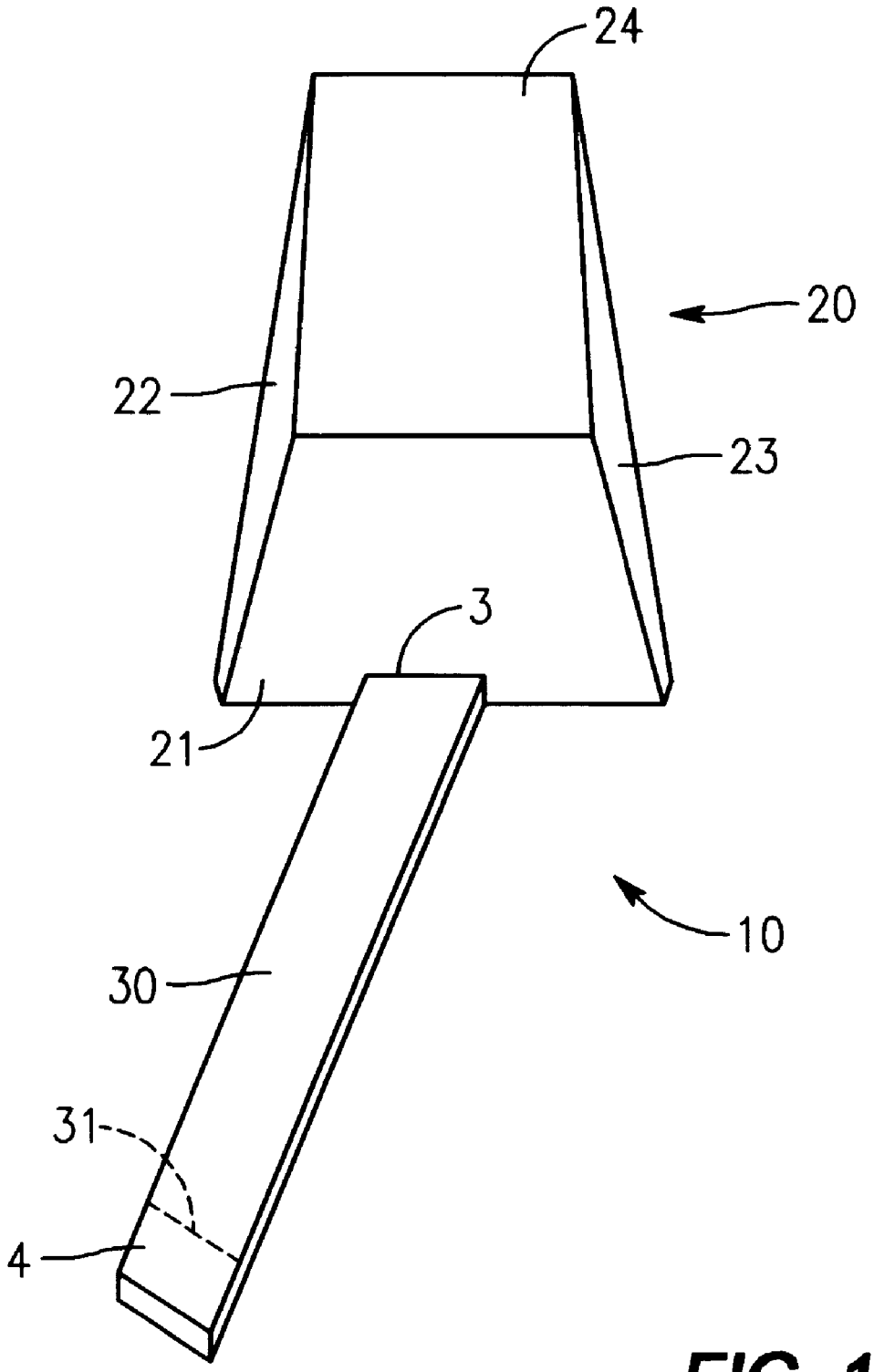
FIG. 1 is a perspective view of the shield for the hand tool.

FIG. 1 illustrates, in perspective view, the preferred embodiment of the shield 10 comprising a guard 20 and a guard handle 30. The guard 20 is comprised of five sides, a top 24, a left side 22, a right side 23, a front side (not shown), and a rear side 21. The bottom portion of the guard 20 is open, where the open portion forms an aperture. The preferred material for the guard 20 is plastic. However, acrylic, plexi-glass, glass or any transparent, deformable, resilient material may also be used. The material should be transparent and suitably strong enough to withstand the impact sustained from flying debris such as bits of wire or solder. The guard handle 30 has a first end 30*a* and a second end 30*b*. The guard handle first end 30*a* connects to the guard 20 at the guard rear side 21. The guard handle 30 material is also preferably plastic. However any deformable resilient material may be used for the guard handle 30; it is important that the guard handle 30 be deformable and resilient since the guard handle 30 is designed to endure repeated deflections during the lifetime of the guard handle 30. The preferred construction of the shield 10 is a single-piece construction. Single-piece construction reduces problems of connecting the guard 20 to the guard handle 30, reduces fabrication costs, and enhances durability and toughness where the guard handle 30 connects to the guard 20. However, the shield 10 may also be comprised of multiple components and the guard 20 attached to the guard handle 30. The guard 20 may be attached to the guard handle 30 by screws, glue, or the two pieces may be fused together.

Figure 2:
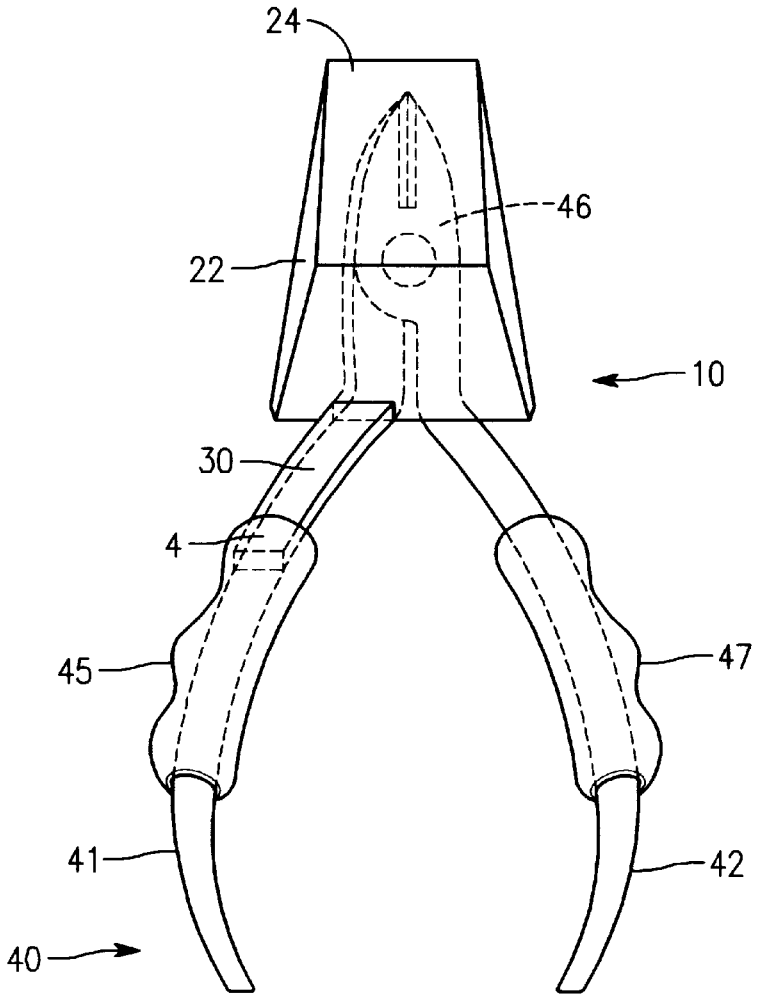
FIG. 2 is an overhead view of the shield for a hand tool attached to a hand tool.
Figure 3:
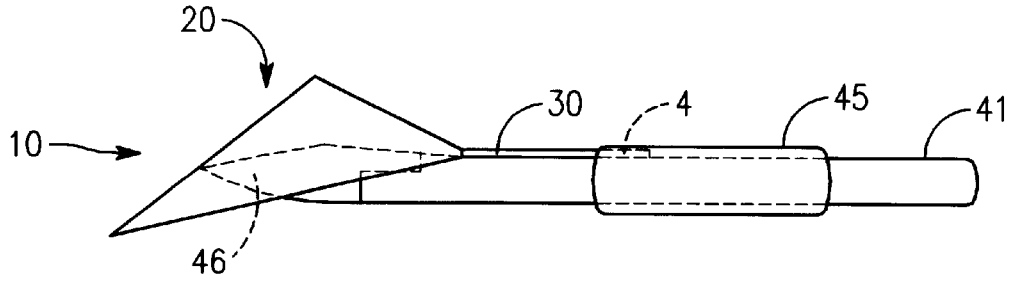
FIG. 3 is a side view of the shield for a hand tool attached to a hand tool, the shield for a hand tool in the first position.

FIGS. 2 and 3 illustrate in perspective view, the shield 10 in combination with a hand tool 40—wherein the shield 10 is in the first position. The hand tool 40 is comprised of a cutting end 46, a first handle 41 and a second handle 42. Hand grips 45 are attached, as shown, to the first handle 41 and to the second handle 42. The guard handle second end 30*a* is wedged between the hand grip 45 and the first handle 41, thus securing the shield 10 to the hand tool 40. The guard 20 is formed to substantially envelope the hand tool cutting end 46. The hand grips 45 are usually comprised of rubber, plastic or any suitable polymeric material. However, the hand grips 45 should be sufficiently deformable to allow the guard handle second end 30*a* to be wedged between the hand grips 45 and the first handle 41 or the second handle 42 and resilient enough to retain the guard handle second end 30*a* frictionally affixed to either the first handle 41 or the second handle 42. Typically the hand grip 45 material is material suitable for electrical insulation.

Figure 4:
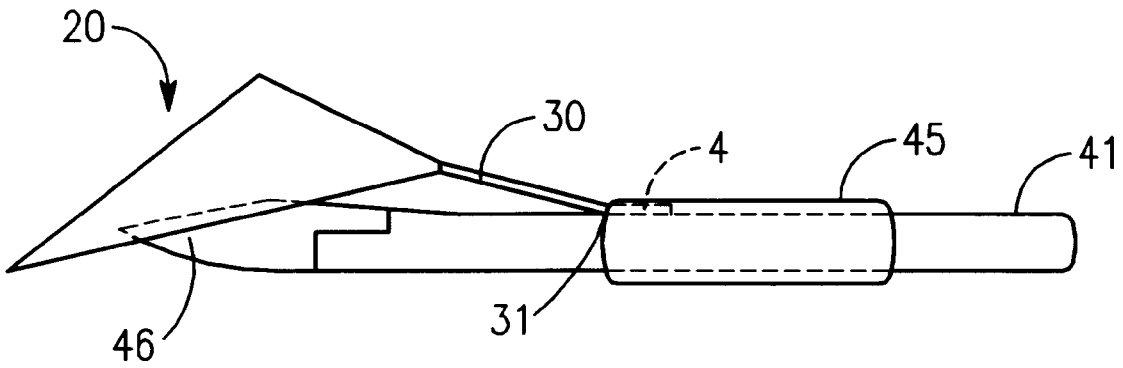
FIG. 4 is a side view of the shield for a hand tool attached to a hand tool, the shield for a hand tool in the second position.

FIG. 4 illustrates the shield 10 in combination with a hand tool 40—wherein the shield 10 is in the second position. In the second position the guard handle 30 pivots about the guard handle pivot plane 31. The guard handle pivot plane 31 is substantially perpendicular to the guard handle 30. Pivoting the guard handle 30 urges the guard 20 up and away from the hand tool cutting end 46, while the guard 30 still remains between the hand tool user and the hand tool cutting end 46.

Figure 5:
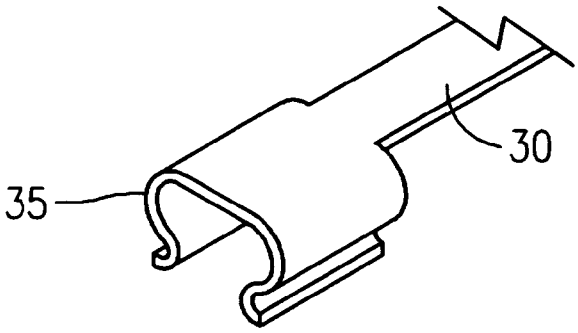
FIG. 5 depicts an alternative embodiment of the means for attaching the shield for a hand tool to the hand tool.

FIG. 5 depicts an alternate means for connecting the shield 10 to a hand tool 40. Provided on the guard handle second end 30*b* are clips 35 for grappling hand tool handles, 41 or 42. The clips 35 should be resilient and able to withstand repeated deformations and stresses. The preferred material for the clips 35 is metal such as stainless steel, however cast iron, or any other suitable alloy could be utilized. Additionally, plastic, rubber or some other polymer may also be used to fabricate the clips 35. The clips should also be fabricated to conform and adhere to various sizes and shapes of hand tool handles 41 or 42, without being permanently deformed.

In operation, the shield 10 is attached to a hand tool 40. The hand tool 40 typically under consideration is a wire cutter. However, the shield 10 may be combined with standard pliers. needle-nosed pliers, vice grips, channel locks or any type of hand tool used for cutting or snipping wire, wire strands or solder. A preferred method of attaching the shield 10 to a hand tool 40 involves wedging the guard handle second end 30*a* between the hand grip 45 and the first handle 41, thus frictionally securing the shield 10 to the hand tool 40. An alternative method of attaching the shield 10 to a hand tool 40 consists of clips 35 connected to the guard handle second end 30*b*, wherein the clips 35 are capable of grappling the hand tool handles, 41 or 42, at numerous locations along the hand tool handles, 41 or 42. The clips 35 can also be formed to grip the hand tool cutting end 46, thus securing the shield 10 at the hand tool cutting end 46.

Once the shield 10 is secured onto the hand tool 40, the hand tool 40 may be used to snip wire, solder, or any other material, without the threat of flying debris causing injury to the user of the hand tool or personnel adjacent to the user. Typically in the "at rest" or first position, the shield 10 envelops the cutting edge of the hand tool 40, the hand tool user can then place the hand tool 40 into a cutting position. The wire or solder is usually close to the surface of a circuit board, or some other electrical or electrical-mechanical system. When the hand tool 40 is urged close to the cutting position the guard 20 will come into contact the surface of the circuit board, or other surfaces from which the wire or other material to be snipped protrudes. After contacting the aforementioned surface the guard 20 will then be urged above the cutting edge of the hand tool 40 into the second position. While the guard 20 is urged above the cutting edge of the hand tool 40 the guard handle 30 pivots about the guard handle pivot plane 31. Even though the guard 20 is urged above the cutting edge of the hand tool 40, if a shard of wire, solder or any other material is propelled out during cutting, the shard will impact the guard 20 instead of user of the hand tool, or any other individuals proximate to the work area. Since the shard impacts the guard 20, potential injury is eliminated to the user of the hand tool, or others adjacent to the user. After the cutting operation is completed and the hand tool 40 is moved away from the cutting position, the guard 20 will no longer contact the surface of the circuit board from which the cut material protruded, and the inherent resiliency of the guard handle 30 will cause the guard handle 30 and guard 20 to return to the first position. When the guard 20 is in the first position., it envelopes and protects the hand tool cutting end 46.

Use of the present invention, a shield for a hand tool, can be used to prevent injuries in the home and industry. A multitude of hand tools are utilized to cut or trim material; these tools can be wire cutters, standard pliers, needle-nose pliers, channel locks or vice-grips. All of the aforementioned hand tools are typically used at or around the hand tool user's home, or during construction or fabrication of hardware. During every material cutting or snipping operation with a hand tool the threat of physical injury is present to the user or others. Implementation of a shield for a hand tool, that is capable of being connected to the hand tool, can prevent this threat of injury.

The foregoing disclosure and description of the invention is illustrative and explanatory thereof, and various changes in the size, shape, and materials, as well as in the details of the illustrated and described invention may be made without departing from the spirit of the invention.

What is claimed is:

1. A shielded wire cutter comprising a first arm, a second arm and a shield;

wherein the first end of said first arm terminates into a cutting edge, the second end of said first arm forms a handle, the first end of said second arm terminates into a cutting edge, the second end of said second arm forms a handle, and said first arm and said second arm are pivotally connected and continually adjustable between an open position and a closed position;

whereby when said first arm and said second arm are in said closed position said cutting edge of said first arm and said cutting edge of said second arm come into contact; and wherein said shield comprises a volumetric enclosure constructed of resilent, deformable material, said volumetric enclosure provides an aperture, said volumetric enclosure envelopes said first ends of said first arm and said second arm when said first arm and said second arm are adjusted to said closed position, and said shield is detachably attached to one of said first arm or said second arm;

whereby said shield may be resilently deformed to permit withdrawal of said first ends of said first arm and said second arm through said aperture to the exterior of said volumetric enclosure while said first arm and said second arm are being adjusted to said closed position.

2. A shield for a cutting portion of a hand tool, wherein said shield is comprised of a resilient deformable material, said shield provides a volumetric enclosure and a handle, said volumetric enclosure provides an aperture permitting passage of said cutting portion into and out of said volumetric enclosure, and said handle provides a first end which is attached to said volumetric enclosure, a second end which is attachable to said hand tool, and a longitudinal axis;

whereby said handle may be resiliently deformed and pivoted perpendicular to said longitudinal axis causing passage of said cutting portion through said aperture out of said volumetric enclosure.

3. The shield of claim 2 wherein said handle and said volumetric enclosure are comprised of a single piece of material.

4. The shield of claim, 2 wherein said volumetric enclosure envelopes said cutting edge until said shield is subjected to pressure deforming and pivoting said handle perpendicular to said longitudinal axis thereby permitting passage of said cutting portion out of said volumetric enclosure.

5. The shield of claim 2 wherein said shield is additionally comprised of a transparent material.

6. The shield of claim 2 wherein said second end is detachably attached to said hand tool.

* * * * *